United States Patent [19]

Schneider et al.

[11] 4,268,273

[45] May 19, 1981

[54] KINDLE MAKER

[76] Inventors: Eugene S. Schneider, 574 Skippack Creek Rd., Collegeville, Pa. 19426; Kent A. Schneider, Rte. 7, Box 478A, Gainesville, Ga. 30501

[21] Appl. No.: 82,711

[22] Filed: Oct. 9, 1979

[51] Int. Cl.[3] ..... C10L 11/08

[52] U.S. Cl. ..... 44/35

[58] Field of Search ..... 44/34, 35, 38

[56] References Cited

U.S. PATENT DOCUMENTS 727,181 5/1903 Moser ..... 44/34

FOREIGN PATENT DOCUMENTS 6019 of 1888 United Kingdom ..... 44/34 B 114940 4/1918 United Kingdom ..... 44/34

384828 12/1932 United Kingdom ..... 44/34 C

*Primary Examiner*—Carl F. Dees

*Attorney, Agent, or Firm*—Benasutti Associates, Ltd.

[57] ABSTRACT

The present invention provides a cylindrical container which is slit longitudinally and is designed to receive kindling material thereinside. The container is opened along the slit and lined with paper that extends beyond and folds back over the ends of the cylinder when it is closed. Fastening members keep the cylinder closed along the slit when in use, and cutout portions are provided through the cylinder through which tape can be affixed to the newspaper so that it will not fall apart when the cylinder is opened. Kindling material is simply inserted into the paper-lined cylinder from either end to form a kindling bundle. When the bundle is completed, the ends of the paper are unfolded away from the cylinder; the fastening members are released; the cylinder is opened; and the paper wrapped bundle is removed therefrom.

10 Claims, 3 Drawing Figures

KINDLE MAKER

BACKGROUND OF THE INVENTION

The present invention relates to a device for starting fires and in particular relates to a device for gathering and preparing kindling into a compact and readily burnable form to aid in fire starting.

It is well known that the best way to start a fire, especially a log fire in either a fireplace or a woodstove is to build up the woodpile by starting with a kindling layer. This layer of kindling material is much more easily ignited than the larger logs which will eventually be burned, and once the kindling begins to burn, the heat developed thereby acts to ignite the larger logs. There are, of course, many substances which can be used as kindling-newspaper and small, split pieces of wood being two very common examples.

With today's increased demands for fuel and energy conservation, there is renewed interest in heating by using wood as a heat source. More homes are being built with wood burning fireplaces, and there is a marked interest in wood burning stoves as both supplemental, and, primary heat sources. And, with the increasing rise in the cost of natural gas and heating oil, this trend toward burning wood as an alternate energy source is certain to continue.

As pointed out above, the customary manner of starting a wood fire is to use some form of kindling or other easily ignitable substance to start the fire. Over the years, various devices have been developed for use as kindling. In fact, U.S. Pat. Nos. 908,615 and 987,921 to Sendlein, 1,099,529 to Wittman, 1,447,237 to Coyne, 390,610 to MacBrair, and 1,199,999 to Lucas, have all issued on types of kindling devices.

All of these devices, however, seem to have a similar drawback in that they require some type of relatively expensive or complicated construction, and usually, the entire device, especially in the Sendlein and Wittman patents, is consumed as a result of its use to start the fire. With the greatly renewed interest in burning wood, it is readily apparent that some new, uncomplicated, and inexpensive device is necessary which can be used to prepare kindling for fire starting. Furthermore, rather than having the device be consumed and used only once, today's tendency toward conservation and recycling dictates that the device also be reuseable.

SUMMARY OF THE INVENTION

In view of the requirements set forth above, it is a primary objective of the present invention to provide a new device which can be used to prepare kindling for starting fires.

It is a futher objective of the present invention to provide a device which is used to prepare kindling, but which is not, itself, consumed during the kindling process.

Furthermore, an objective of the invention is to provide a device which may be used repeatedly to produce kindling.

It is also an objective to provide a kindle-making device which is lightweight, easy to manufacture and assemble, which is rugged and durable, and which prepares kindling in a neat and clean manner.

Finally, it is an objective of the invention to provide a device which can be used to collect into one easily handleable, and easily ignitable unit, small combustible materials, such as twigs, branches, pine cones, dry leaves, scraps of lumber, etc., thereby greatly decreasing the cost of providing kindling, and at the same time making it possible to easily and economically use small materials which by themselves would probably not otherwise be used as kindling material.

The present invention provides a cylindrical container which is slit longitudinally and is designed to receive kindling material thereinside. The container is opened along the slit and lined with a combustible material such as paper that extends beyond and folds back over the ends of the cylinder when it is closed. Fastening members keep the cylinder closed along the slit when in use, and cutout portions are provided through the cylinder through which tape can be affixed to the newspaper so that it will not fall apart when the cylinder is opened. Kindling material is simply inserted into the paper-lined cylinder from either end to form a kindling bundle. When the bundle is completed, the ends of the paper are unfolded away from the cylinder; the fastening members are released; the cylinder is opened; and the paper wrapped bundle is removed therefrom.

BRIEF DESCRIPTION OF THE DRAWINGS

The above and additional objectives will be better understood from the following detailed description taken in conjunction with the formal drawings, wherein.

DETAILED DESCRIPTION OF THE INVENTION

Figure 1:
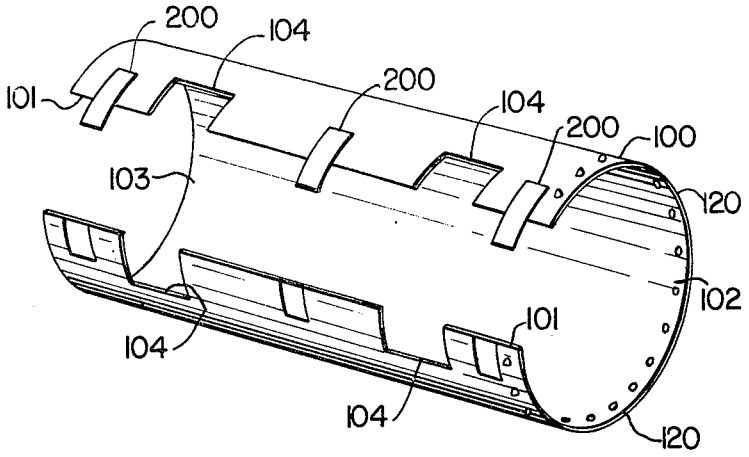
FIG. 1 is a perspective view of the device of the invention in the open condition.

Although specific forms of the invention have been selected for illustration in the drawings, and the following description is drawn in specific terms for the purpose of describing these forms of the invention, this description is not intended to limit the scope of the invention which is defined in the appended claims.

Figure 2:
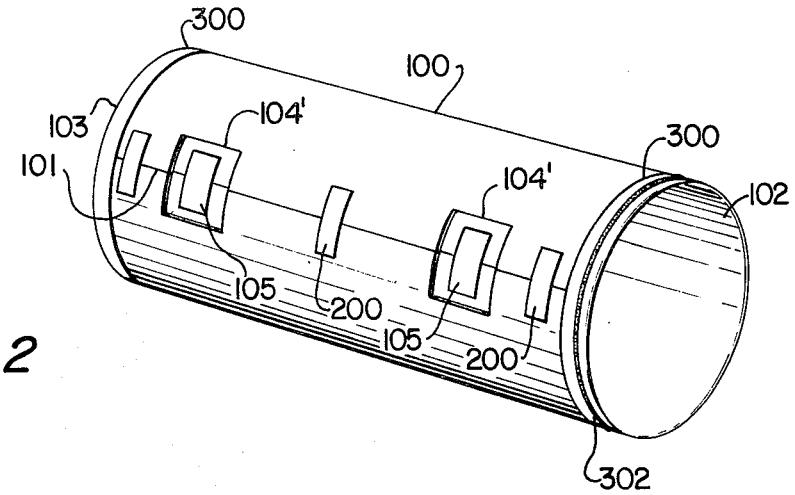
FIG. 2 is a perspective view of the device of the invention in the closed condition.

As shown in FIGS. 1 and 2, the device has a primarily cylindrical shape. In the embodiment shown, a cylinder 100 is provided with a slit 101 so that it may be opened. Both of the ends 102, 103 of the cylinder are open, the significance of which will be discussed later. At several places along the slit 101 are cutout portions 104. When the cylinder is folded closed along the slit (FIG. 2) these cutouts form mated openings 104' which allow access to the interior of the cylinder.

Also featured along the length of the cylinder are a plurality of fastening members 200 which are used to keep the cylinder closed along the slit. These fastening means may be hinge clamps or perhaps even Velco fasteners which will securely hold the cylinder closed. It should be understood that these fasteners may be easily released in order to facilitate opening of the cylinder.

To use the device, the cylinder 100 is opened lengthwise and is lined with newspaper 300 or other combustible material. This paper 300 is positioned within the cylinder to extend beyond the end of the cylinder. Next, the cylinder is closed (FIG. 2); the fastening members 200 are fastened; and the paper is folded back over the ends of the closed cylinder. When the cylinder 100 is closed, the edges of the paper 300 are accessible through the mated cutout openings 104'.

After the newspaper has been folded back over the ends of the cylinder, it may be held securely in place with a flexible member, such as a rubberband 302 or other retaining device which will fit easily around the newspaper and cylinder. Also, clips (not shown) may be provided which will clip over the end edges of the cylinder to hold the paper in position.

Depending on the type of material which comprises the cylinder, a retaining device may be formed or incorporated into the ends of the cylinder which could be used to hold the paper lining once it is folded around the outside of the cylinder. For example, if the cylinder is lightweight metal, metal semi-circular punch out tabs 120 may be provided. The tabs 120 would be easily bent outwardly from the cylinder if desired, and the newspaper lining simply pressed over these punch outs to hold it securely. It is possible to pre-stamp these punch outs in a metal cylinder, and allow the user to bend them outward at a later time if he so desires. A second example, not shown, would be to simply serrate the edges at the ends of the cylinder.

Once the cylinder is closed, lined and secured, the edges of the paper accessible through the mated openings 104' (FIG. 2) are secured with heavy tape 105 or any other suitable means to keep the paper from opening along its length. Then, the cylinder may be filled inside the paper lining with many types of kindling material such as: twigs, dry leaves, pine cones, sticks, etc. and/or other combustible material, from either open end until it is full. After being filled, the retaining device 302 is removed; the ends of the paper are unfolded away from the cylinder; the fastening members are released; and a paper-wrapped and taped kindling bundle is removed from the open cylinder. This kindling bundle is complete and is ready to be used immediately or stored for future use as kindling in woodburning stoves, fireplaces, etc.

The cylinder is preferably circular, but other outside configurations are acceptable as long as they may be opened along the length thereof and lined with newspaper. Lightweight metal, for example stove piping, may be used for the container material, as may be a heavy grade of flexible plastic-like material, molded rubber, or even a heavy grade of paper, such as a multi-ply paper tube. The material used should be durable and weatherproof for use out of doors, and should be capable of retaining its flexibility at low temperatures.

Figure 3:
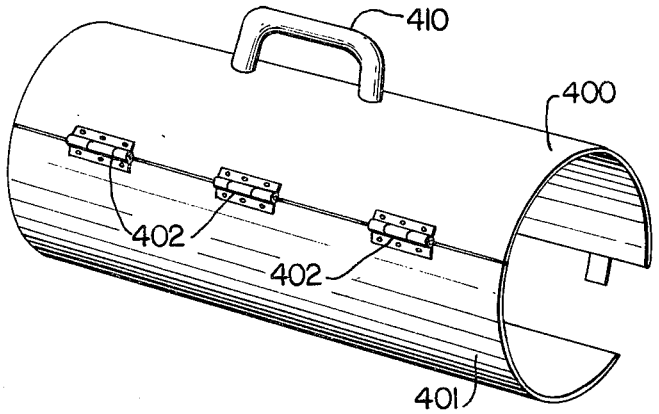
FIG. 3 is a perspective view of a second embodiment of the invention wherein the container has two hinged together halves.

It is also envisioned that the cylinder may be formed of two semi-circular pieces 400, 401 (FIG. 3) which are hinged together by hinge members 402 along one longitudinal edge to form the cylindrical configuration of the device. These hinge members 402 may be ones which are easily separated so that the two semi-circular parts may be disconnected for handling or storage one inside the other. Also, as shown in FIG. 3, a handle 410 may be affixed to the cylinder so that it may be carried more easily.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. A kindling-making apparatus comprising:

(a) hollow, open-ended container means having at least one longitudinal slit therealong and having cutout portions therethrough into the interior thereof for receiving a lining material and kindling material thereinside; and (b) fastening means connected to said container means along said slit for securely closing said container means at said slit.

2. An apparatus as claimed in claim 1, further comprising:

(a) retaining means at the ends of said container means for retaining a lining material folded outward around the ends of said container means.

3. An apparatus as claimed in claim 1, wherein said container means is cylindrical.

4. An apparatus as claimed in claim 1, wherein said container means is comprised of light-weight metal.

5. An apparatus as claimed in claim 1, wherein said container means is molded rubber.

6. An apparatus as claimed in claim 1, wherein said container means is a multi-ply paper tube.

7. An apparatus as claimed in claim 1, wherein said container means is a flexible plastic-like material.

8. An apparatus as claimed in claim 1, wherein said container means is comprised of two halves and hinge means for connecting said two halves.

9. An apparatus as claimed in claim 1, further comprising a carrying means affixed to said container means.

10. An apparatus as claimed in claim 2, wherein said retaining means is a flexible member removably fitted around each end of said container means.

* * * * *